United States Patent [19]

Solf et al.

[11] 3,971,094

[45] July 27, 1976

[54] BRUSH HANDLES

[76] Inventors: Johannes Solf, Lindenstr. 39, 7031 Aidlingen; Wolfgang Feine, Simoniussteige 16, 7988 Wangen, Allgau, both of Germany

[22] Filed: Dec. 12, 1974

[21] Appl. No.: 532,203

Related U.S. Application Data

[63] Continuation-in-part of Ser. No. 350,938, April 13, 1973, abandoned.

[52] U.S. Cl. ..... 15/143 R

[51] Int. Cl.[2] ..... A46B 5/02

[58] Field of Search ..... 15/143 R, 159 R, 171, 15/191, 192, 193, 202, 230.11, 27, 248 R

[56] References Cited

UNITED STATES PATENTS

| | | | |
|---|---|---|---|
| 1,587,481 | 6/1926 | Erickson et al. | 15/248 R |
| 1,826,165 | 10/1931 | Cartwright | 15/143 R |
| 2,087,888 | 7/1937 | Adams | 15/230.11 |
| 2,664,582 | 1/1954 | Kammann | 15/143 R |
| 3,386,124 | 6/1968 | Feine | 15/143 R X |
| D90,978 | 11/1933 | Gadd | 15/143 R UX |
| D126,048 | 3/1941 | Lang | D4/39 X |

*Primary Examiner*—Daniel Blum
*Attorney, Agent, or Firm*—John A. Young

[57] ABSTRACT

A paint roller or ceiling brush handle which is specially adapted to fit an individual's grip and accordingly has two curved circumferential surfaces forming two of the opposite gripping surfaces, such surfaces being joined by opposite circumferentially arched surfaces, convexly shaped. Brush handle is proportioned to be of a length substantially equal to an average adult hand width and the handle is proportioned to fit anatomically the grip of the holder.

2 Claims, 8 Drawing Figures

BRUSH HANDLES

This is a continuation -in- part of application Ser. No. 350,938 filed Apr. 13, 1973, now abandoned.

BACKGROUND OF THE INVENTION

In order to be able to grip and functionally operate a roller or ceiling brush, it is well known to provide handles, but, when gripped, the handles are shaped so that they do not take special note of reducing fatique and slippage. Comfort of grip appears to be an unknown, overlooked, or ignored factor. It is known, however, that in order for a handle to be of optimum construction for gripping and operating the brush in a certain way, the configuration of the handle must take into account hand and forearm geometry. The whole concept of the present invention is to use the grip and handle configuration in such a way that the geometry of the arm and hand is complementary with the handle configuration.

OBJECTS

Accordingly, it is the purpose of the present invention to shape a handle in such a way that the grip, i.e., the contacted portion of the handle, is made surer and more comfortable for individual brushing operations. It is intended that the handle be enclosable by a balled fist, this in distinction to handles of paint brushes which are held like a writing tool.

A further object of the present invention is to form the handle so that it will not readily slide or slip through the hand as the tool is manipulated by hand.

An important feature of the present invention is that the cross-section of the handle is configured at its opposite sides in order to conform with the grip of the user and is therefore ideally structured to enable the user to use the brush or roller handle in such a way as to achieve maximum handleability and reduce fatigue and slippage, by reason of the improved grip or handle.

The handle is of plastic construction which is made of resin which can be spray coated onto a substrate, this being one of the numerous methods of manufacture. The product has longitudinal symmetry; i.e., it is symmetrical about two transverse planes extending midway between each of the opposite pairs of the respective sides.

The sides terminate in ends which are "rounded off" rectangles and at the upper end of the brush the handle is a trapezoidal surface which is merged with the handle section. The foregoing and other objects and features of the invention will become apparent from the consideration of the following detailed description which proceeds with reference to the accompanying drawings.

DRAWINGS

DETAILED DESCRIPTION OF THE INVENTION

Figure 6:
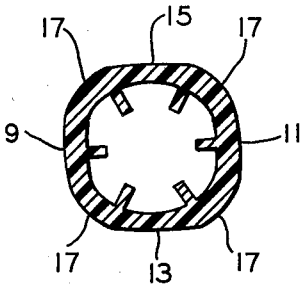
Figure 5:
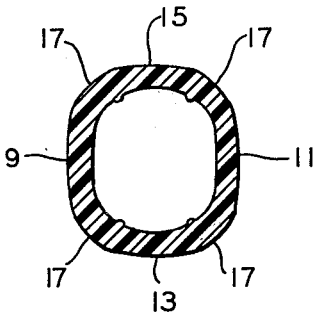
Figure 4:
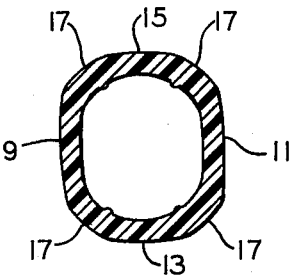
Figure 3:
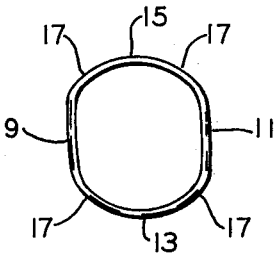

The hand part 1 forms the gripping section for the fingers and it is essentially constructed to be ball-like in order to accomodate to the anatomy of the natural grip of the person holding the brush. The cross-section constitutes an eight cornered shape. At about the midpoint of the handle (FIGS. 5, 6) the handle appears in cross-section as a rounded off square, and the sides converge so that the end of the handle (FIG. 3) appears as a rounded off rectangle.

Figure 1:
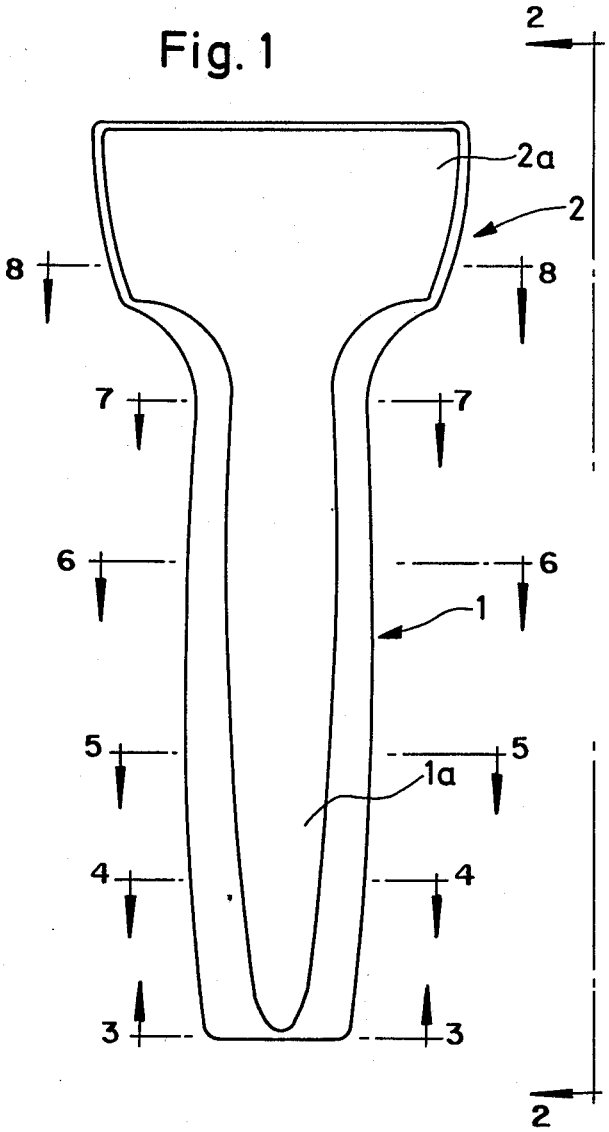
FIG. 1 is a front elevation view of the handle.
Figure 2:
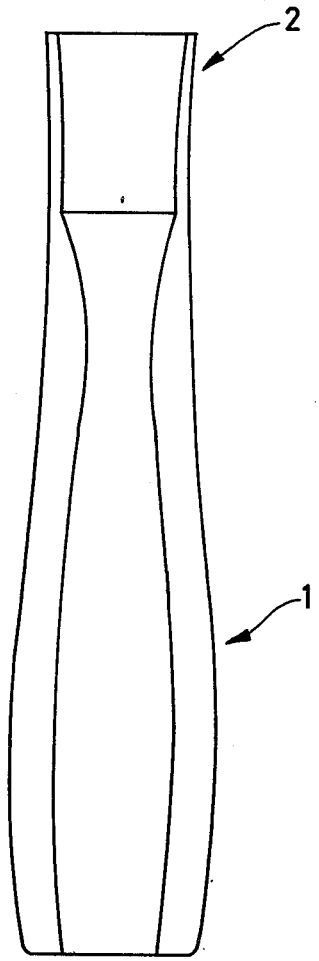
FIG. 2 is a side elevation view looking in the direction of the arrows 2-2 in FIG. 1.
Figure 8:
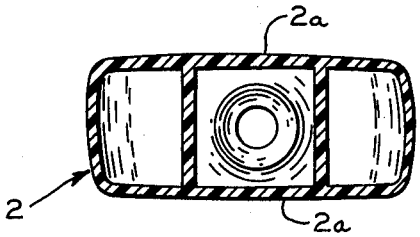
FIGS. 3, 4, 5, 7 and 8 are sectional views taken on the respective section line of FIG. 1.
Figure 7:
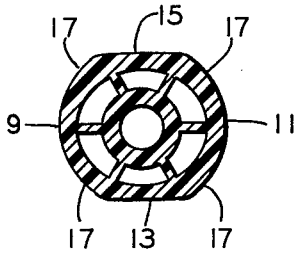

The handle section 1 terminates at end 6 (FIG. 1) in a trapezoidal flattened working end 2*a* where it is connected with a rod (not shown) including a ceiling brush or roller made of lambskin, foam material, etc. attached to the working end 2*a*.

The handle 1 is characterized in two respects — one is that the handle from point 8 to end 4 is convexly shaped and in cross-section has eight corners whereby sides 9, 11, 13 and 15 are all convex and meet at their respective edges in rounded corners 17, with the result being a highly grippable and non-slip configuration.

Another important feature of the present invention is that the shank section 12 has a recess wherein the thumb fits conveniently and comfortably, and is adapted for resisting torque tending to twist or turn the roller either about an axis which is perpendicular to the longitudinal axis of the handle or coincidal with said longitudinal axis. This torque absorption is also a function of the lateral displacement of the thumb from the gripping part on the handle and such thumb lock also serves to keep the handle from sliding through the hand in the event that the handle part is gripped too loosely.

A general feature of the invention is the generally curved configuration of the entirety of the cross-section of the handle which prevents mere point contact and avoids nonuniform pressure distribution between the handle and the hand, to make all parts of the hand work more evenly hence more comfortably and without fatique.

Although the present invention has been illustrated an described in connection with a single example embodiment, it will be understood that this is illustrative of the invention and is by no means restrictive thereof. It is reasonably to be expected that those skilled in this art may make numerous revisions and adaptations of the invention and it is intended that such revisions and adaptions will be included within the scope of the following claims.

What is claimed is:

1. A brush handle which is proportioned to be of a length not substantially greater than an average adult hand width, said handle having two opposed convexly shaped sides which extend between opposite handle ends and arched in opposite directions to provide a maximum width approximately midway of the handle, a second pair of convex sides arched in opposite directions and proportioned to provide a maximum dimension approximately midway of the handle in length, such pair of opposed sides being joined by edges running in the direction of the axis of the handle length and adapted to form an eight cornered cross-sectional shape providing a ball-like configuration whereby substantially uniform pressure distribution is effected between the grip of the user and the confronting surfaces of the handle, recess means forming a contact surface for the thumb at that end of the handle forming a tool-mounting shank to absorb torque produced through the laterally off-set resultant forces which are non-collinear with the longitudinal axis of the handle, and trapezoidal flattened portions flaring in the direction of the brush end of said handle and disposed at the end of said handle which forms the base of the handle.

2. The handle construction in accordance with Claim 1 wherein each of the said eight cornered cross-sectional surfaces are characterized by relatively smooth and gradual transition from the sides adjoined by such corners.

* * * * *